United States Patent [19]

Koontz

[11] 4,184,416

[45] Jan. 22, 1980

[54] COMBINATION THERMAL INSULATION STOP AND VENTILATION BAFFLE ARTICLE

[76] Inventor: Bryce L. Koontz, 125 Oklahoma, Anchorage, Ak. 99504

[21] Appl. No.: 910,602

[22] Filed: May 30, 1978

[51] Int. Cl.[2] ..... F24F 7/00

[52] U.S. Cl. ..... 98/37; 98/DIG. 6; 52/95; 52/198

[58] Field of Search ..... 98/32, 37, 35, 42 R, 98/DIG. 6; 52/198, 199, 302, 303, 95, 92, 406, 407; 248/57

[56] References Cited

U.S. PATENT DOCUMENTS

| | | | |
|---|---|---|---|
| 573,452 | 12/1896 | DeLahunt | 52/92 |
| 2,094,635 | 10/1937 | Brooks | 52/407 |
| 2,713,983 | 7/1955 | Kay | 248/57 |
| 3,019,864 | 2/1962 | Lester | 52/407 |
| 3,160,987 | 12/1964 | Pinkley | 52/407 |
| 3,777,649 | 12/1973 | Luckey | 52/95 |
| 3,863,553 | 2/1975 | Koontz | 98/32 |
| 3,972,164 | 8/1976 | Grange | 98/DIG. 6 |
| 4,023,323 | 5/1977 | Fortin | 52/406 |
| 4,069,628 | 1/1978 | Kreimer | 98/32 |
| 4,096,790 | 6/1978 | Curran | 98/32 |

*Primary Examiner*—Henry C. Yuen

*Attorney, Agent, or Firm*—Wells, St. John & Roberts

[57] ABSTRACT

An insulation stop and ventilation baffle article is described for assisting in the installation of loose fiber or particulate thermal insulation in the crawl space or attic between a ceiling and roof of a building structure. The article is constructed of a rather stiff sheet material having parallel side fold lines formed therein adjacent to and spaced inwardly from parallel side edges. The fold lines define side sections that may be folded upwardly to receive the ends of an elongated flexible rod. Clamp members are slidably engageable over the ends of the rod to slide inwardly and contact the side sections and hold them in an upwardly folded condition. The length of the rod is slightly greater than the corresponding horizontal distance between roof rafters. Also, the distance between the fold lines is slightly less than this rafter spacing. Therefore, the article may be inserted between the rafters with the ends of the rod engaging the rafters and causing the rod to bend along its length. The spring action of the rod will operate against the adjacent rafters to hold the article in place relative to the plate of an adjacent exterior wall and the roof sheeting while insulation is blown into the area against the inwardly facing surface of the baffle. The baffle will prevent seepage of insulation into the air passage leading to ventilators in the eaves and allow a maximum buildup of insulation above the exterior wall plates.

4 Claims, 9 Drawing Figures

COMBINATION THERMAL INSULATION STOP AND VENTILATION BAFFLE ARTICLE

BACKGROUND OF THE INVENTION

This invention relates to insulation stops and ventilation baffles which are utilized to assist in the installation of loose fiber or particulate thermal insulation to the crawl space or attic between the ceiling and roof of a building structure.

Water damage in dwelling structures can often be attributed to inadequate thermal insulation of the ceiling and insufficient ventilation of the air space immediately below the roof and above the ceiling. If there is inadequate insulation and ventilation, heat lost through the ceiling will warm the roof and cause the snow or ice thereon to run down the roof toward the eaves. Since the eaves are normally are the same temperature as the outside environment, the previously melted snow will refreeze, causing ice to build up, lifting and flowing beneath the roofing material. When the buildup thaws, the water often flows onto the ceiling and down the inside of exterior structural walls. To prevent this type of water damage it is necessary to adequately insulate the ceiling to minimize heat loss and to provide good ventilation to the attic or air space between the roof and ceiling in order to maintain the temperature of the roof close to the outside temperature. By doing so, snow is prevented from melting and running down the roof to subsequently refreeze at the eaves.

Loss of heat through the ceiling of a building is normally due to inadequate insulation coverage of the area directly above the ceiling between the ceiling joists. New methods have been developed to permit fiber or particulate insulation material to be pneumatically blown into the crawl or attic space below the roof and directly between the ceiling joists. Such methods are especially effective for applying loose fiber or particulate insulation to areas where access is normally limited.

It has been found where soffit ventilators are used that unles considerable caution is exercised during installation of the loose fiber or particulate insulation, poor ventilation can result. Insulation can be lost if adequate precautions are not taken. It is not uncommon for applicators to entirely fill the space between the ceiling and roof over the bearing plate of the exterior walls. When this occurs, air circulation through the soffit ventilators is restricted if not totally blocked. Additionally the insulation becomes ineffective when it falls through this space between the ceiling and roof rafters into the soffit area. The answer has been to provide baffles that block passage of insulation into the eaves but retain an air passageway for ventilation.

A distinct problem with prior forms of combined insulation stops and ventilation baffles is in the physical placement of the baffles between the roof rafters. Typically, the installer was required to get as physically close to the exterior wall plate as possible in order to install the baffle properly. This was due to the requirement that the baffle be firmly attached to the rafters or plate before it would support itself in place and effectively perform its job of preventing insulation from falling into the eaves. The typical baffle is installed by the use of staples. Still, notwithstanding the fasteners, the problem remains of physically being able to approach the soffit area when the roof pitch is relatively low. Additionally the installer must be careful to avoid stepping between the ceiling joists (since the only material between the joists is often some form of nonstructural material). It therefore becomes desirable to obtain some form of insulation baffle that is quickly and easily installed from positions spaced from the eaves.

BRIEF DESCRIPTION OF THE DRAWINGS

The present invention is illustrated in the accompanying drawings in which.

DETAILED DESCRIPTION OF A PREFERRED EMBODIMENT

Figure 1:
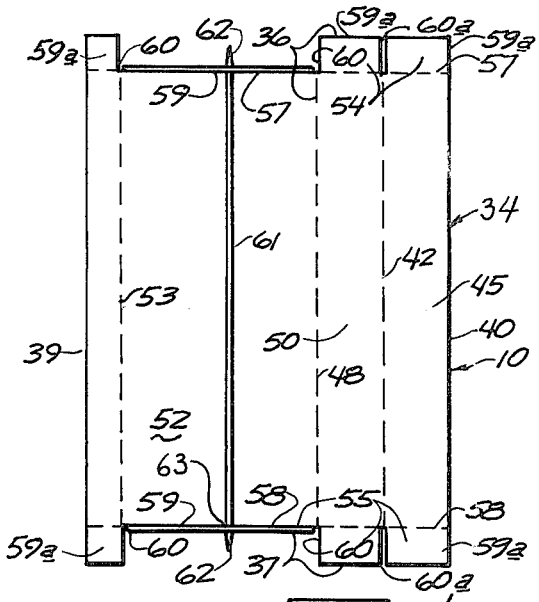
FIG. 1 is a plan view of a combination insulation stop and ventilation baffle article comprising the principal features of this invention.
Figure 3:
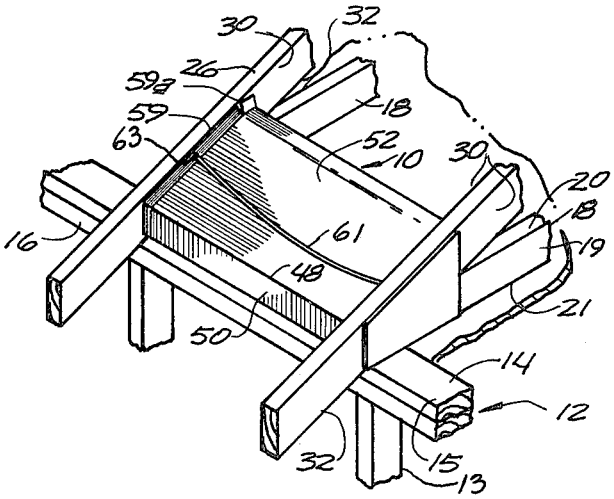
FIG. 3 is an isometric view showing the article mounted between two roof trusses.
Figure 4:
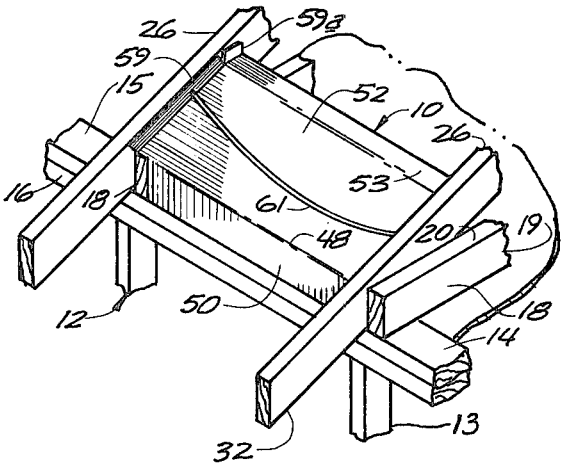
FIG. 4 is an isometric view showing the article mounted between roof rafters and a ceiling joist of standard framing, the article configuration in use being that shown in FIG. 2.
Figure 7:
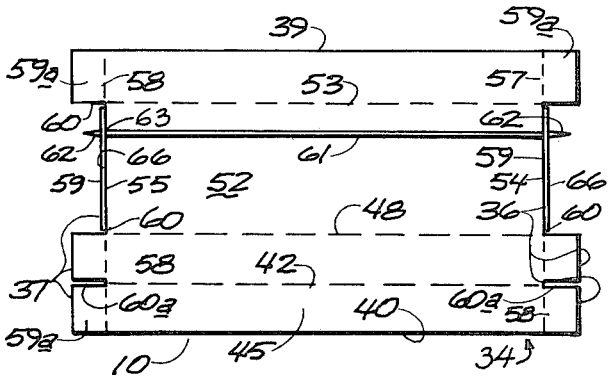
FIG. 7 is a view similar to FIG. 1 only showing different positioning of the flexible rod thereon.

Referring now in detail to FIGS. 1 and 7, a combination insulation stop and ventilation baffle article is illustrated and designated with the numeral 10. The article 10 is for use in a building structure 12 (FIGS. 3 through 5, 8 and 9) having an exterior wall 13 with a bearing plate 14 mounted at the top thereof. The bearing plate 14 has an upper surface 15 and an outer surface 16 facing the exterior of the structure 12. The building structure has ceiling joists 18 that are generally positioned at equally spaced locations along the wall for supporting a ceiling 24. Generally, the joists 18 are spaced 16 inches or 24 inches on center. Each ceiling joist 18 includes side surfaces 19, upper edge surface 20 and a lower edge surface 21. The lower edge surfaces 21 of joists 18 bear on the upper surface 15 of plate 14. The roof structure includes rafters 26 that extend downwardly and outwardly over the exterior wall operatively connected to the ceiling joists 18 to form integral roof truss frames as illustrated in FIGS. 3 and 4. Each roof rafter 26 has an upper edge 27 supporting a roof sheeting 28. Also, each roof rafter 26 has side surfaces 30 and a lower edge 32.

Figure 2:
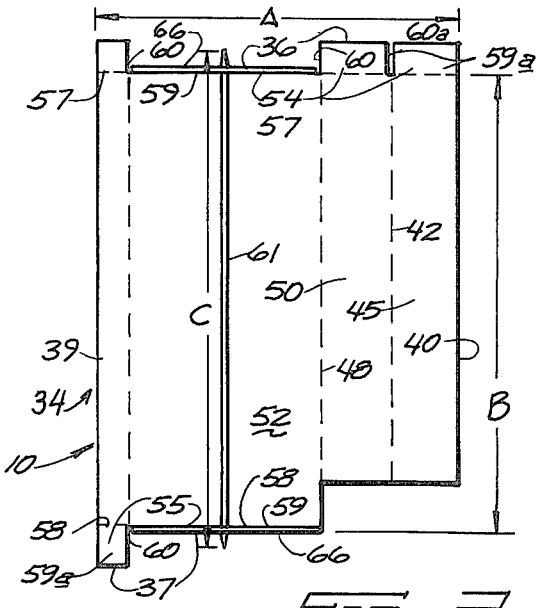
FIG. 2 is a similar view showing the baffle shaped to be received between roof rafters and ceiling joists of standard framing construction.

The present article 10 generally includes a body 34 that is made of sheet material of rather stiff and moisture-proof construction. Wax coated corrugated paperboard has been found to be satisfactory. In a preferred embodiment, the corrugations of the paperboard extend in the transverse direction between side edges 36 and 37 of the body. The body 34 further is defined a. .ng its periphery by a top edge 39 and a bottom edge 40. The length distance or height of the body between top edge 39 and bottom edge 40 is illustrated in FIG. 2 by the letter "A". Distance "A" of the body 34 is substantially greater than the vertical distance from the upper surface 15 of plate 14 to the roof 28 as measured immediately above the plate 14.

Figure 5:
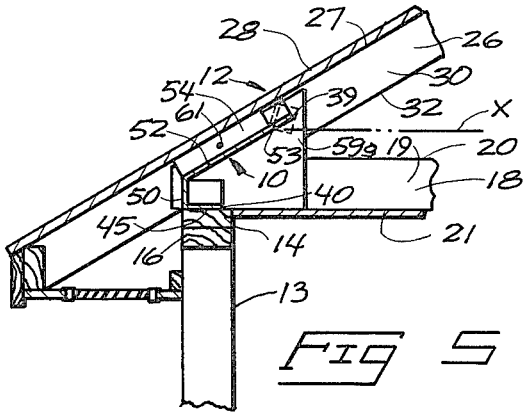
FIG. 5 is a fragmentary sectional view of a wall and roof arrangement showing positioning of the present invention in relation to the exterior wall plate and roof rafters.
Figure 9:
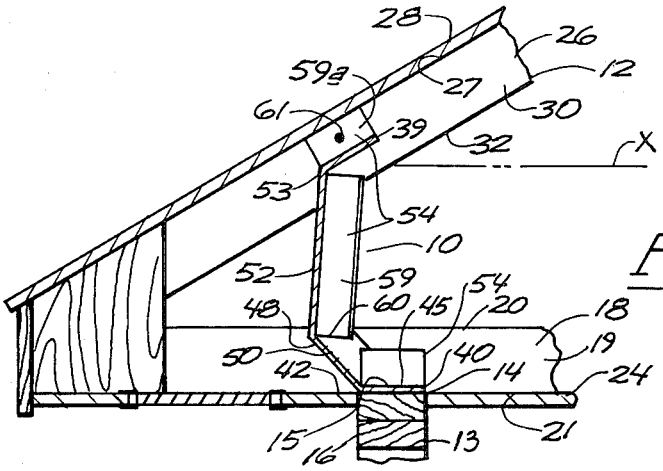
FIG. 9 is a fragmentary sectional view showing the device in position on another form of roof arrangement.

The body 34 may include a first transverse end fold line 42 that extends between the side edges 36 and 37 inwardly spaced from the bottom edge 40. It forms a horizontal end tab or plate section 45 for engaging the plate as shown in FIGS. 5 and 9. The distance between the bottom edge 40 and the first transverse fold line 42 is preferably less than the width of the plate 14. This enables the installer to locate the baffle such that the plate section 45 comes into direct abutment with the surface 15 of the plate 14.

The body 34 may also include a second transverse fold 48 that is parallel with the first transverse fold 42 and spaced inwardly therefrom forming an intermediate vertical section 50 (FIG. 5). The distance between fold 42 and the second fold 48 is preferably greater than two inches but less than the height of ceiling joist 18 from the lower edge surface 21 to top edge surface 20. Additionally, the second transverse fold 48 forms an upper central section 52 that extends from the second transverse fold line 48 to the top edge 39. The distance between the second fold line 48 and top edge 39 is greater than the distance from the top surface 20 of the joist 18 to the roof 28 immediately above the plate 14. A third transverse fold line 53 may be provided adjacent edge 39 to form a tab that will allow closing of the air passages shown by FIG. 5 in dashed lines.

The body 34 additionally includes side sections 54 and 55 that are defined by the side edges 36 and 37 and by inwardly spaced side fold lines 57 and 58 respectively. The width between the fold lines 57 and 58 is illustrated in the drawings by the letter "B" and is complementary to or slightly less than the horizontal spacing between the ceiling joists 18 and the horizontal spacing between the roof rafters 26.

The side sections 54 may be divided as shown in FIGS. 1, 2 and 7 to include a number of foldable flaps, each being an extension of its adjacent, interconnected body portion 45, 50 and 52. Specifically, fold tabs 59 are formed between spaced slots 60 that are located at the opposite ends of the upper body section 52. Other similar slots 60*a* are provided to facilitate folding along line 42. The slots 60 and 60*a* extend from side edges 36 and 37 inwardly to terminate at the fold lines 57 and 58 to define the fold tabs 59. Fold tabs 59 receive an elongated rod 61. Slots 60 and 60*a* also define small flaps 59*a* that may be removed, leaving only the fold tabs 59.

Rod 61 is resilient and includes a length dimension "C" (FIG. 2) that is greater than the horizontal distance between ceiling joists 18 and the horizontal spacing between the roof rafters 26. Therefore, in order to insert the rod horizontally between adjacent roof rafters, it must be forceably bent along its length such that its ends 62 will be biased outwardly against the engaged rafters.

Figure 8:
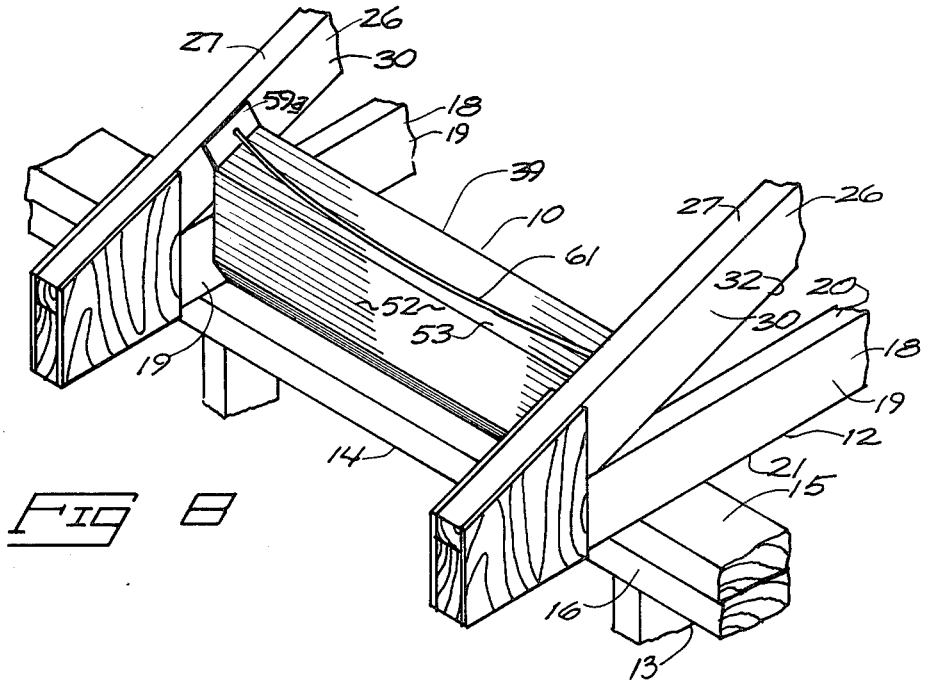
FIG. 8 is a fragmentary isometric view illustrating positioning of a variation of the baffle shown in FIG. 7 between adjacent roof trusses.

The rod ends 62 project through apertures 63 in the fold tabs 59 or, as shown in FIG. 8, through tabs 59*a*. The apertures may be formed during the manufacturing process or may be located by the installer prior to application of the baffles to the building structure. The fold tabs 59 or 59*a* are both folded in the same direction toward one surface of the body 34. As shown in FIGS. 3 through 5, the tabs 59 are folded so as to project upwardly when inserted between adjacent rafters. This assures spacing of the baffle from the roof 24 since the edges 36 and 37 of the tabs will engage the roof and prevent the remainder of the body from sliding upwardly to seal off the desired air passageway.

Figure 6:
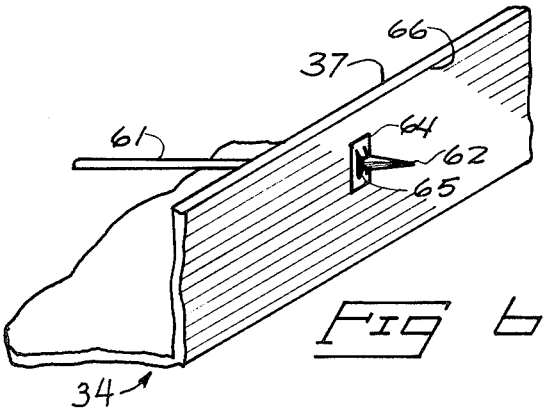
FIG. 6 is an isometric fragmentary view of a portion of the invention showing one end of a flexible rod and a clamp member thereon.

The tabs are held in a folded condition by clip members 64 (FIG. 6) that are receivable over the ends 62 of rod 61. The clip members are placed over the rod ends subsequent to positioning of the rods through the tabs such that the ends 62 project outwardly of the pierced tabs. The clips as shown in FIG. 6 are of the commonly known spring type variety that will slide relatively freely in one direction over a rod but include clip prongs 65 that are sprung against the rod to prevent opposite motion. Therefore, the clip members may be positioned inwardly from the rod ends to engage surfaces 66 of the tabs 59.

Preferably, the spacing between the clips 64 when properly positioned on the rod ends, is slightly less than the width dimension "B". The rod, since it is of a dimension greater than the distance "B" will bend when placed horizontally between roof rafters as shown in FIGS. 3, 4 and 8. This causes the clip members to be likewise moved closer together and correspondingly results in the slight inward inclination of the tabs 59. However, the surfaces of the baffle body along the fold lines 57 and 58 will remain in close proximity to or in contact with the adjacent roof rafters.

FIGS. 3, 4 and 5 illustrate the effect produced by forcing the elongated rod horizontally between roof rafters. When this is done, the resilient rod will become sprung and bow outwardly. The ends 62 will be urged by the spring energy of the rod to move horizontally outwardly. This results in a force against the engaged roof rafters. Sufficient force is supplied by the arched rod against rafters 26 to securely support the baffle at a selected position relative to the roof rafters and wall plate.

The installer may, depending on the condition in which the baffle is supplied, insert the ends of the rod through the tabs 59 or 59*a* and place the clips in proper position so the tabs are folded to approximate right angles to the surface of the upper section 52. After doing this, he may also fold the various other sections 45, 46, etc., about their longitudinal fold lines to a particular desired configuration. This, of course, depends upon the particular structure in which the baffles are to be installed.

The configuration shown in FIGS. 2 and 4 illustrate use of the present baffle with standard framing wherein the surfaces 30 and 19 of the roof rafters and ceiling joists are not located within the same plane. In this situation, it becomes desirable for the installer to cut the baffle to conform to the cross-sectional configuration of the ceiling joists where it intersects the roof rafter. Provisions may be made within the baffle by perforations or line indications of the appropriate outline for the desired cut.

To insert and position the baffle, the installer merely holds the baffle in a substantially horizontal orientation and slides it between the roof rafters toward the plate. In so doing, the rod ends become engaged with the adjacent facing rafter surfaces and bows as the installer pushes the baffle further toward the plate. Once the rod becomes bowed with both ends in contact with the rafters, the baffle is held securely in place. Therefore, the only requirement is that the installer place the baffle with the lower edge 40 at least operatively engaging the plate and with the upper edge 39 spaced downwardly from the roof.

The baffle is preferably inserted with the tabs 59 or 59*a* projecting toward the exterior or roof as shown in FIGS. 3 through 5, or may be inserted with the tabs projecting inwardly as shown in FIG. 9. The advantage of this arrangement is that the edges of the tabs 59 or 59*a* will engage the roof and prevent further movement of the baffle body toward engagement with the roof to thereby to prevent sealing off of the desired ventilation passageway.

Regardless of the method of installation used, it is easily seen that positioning of the present baffle is very simple and quick process. No other fasteners of any other sort are required to hold the baffle in place. The mere spring action of the resilient rod holds the baffle securely in place and prevents it from moving upon reception of the particulate insulation which may fill the area to the lines indicated in FIGS. 5 and 9 at X.

A further advantage in providing the baffles with the resilient rod and clip arrangement is that the baffles may be inserted in very confined areas where the installer may be unable to reach or gain adequate access for a staple gun or hammer. A long-arm clamp arrangement (not shown) could be utilized to position the baffles from a remote location. A simple clamp that is selectively operable from a remote end of an elongated rod would adequately serve this purpose.

It should be understood that the above described embodiment is simply illustrative of the principles of my invention and that numerous other embodiments may be devised without deviating from the intended scope of my invention. Therefore, only the following claims are intended to place restrictions upon the scope of this invention.

What I claim is:

1. A combination insulation stop and ventilation baffle for mounting over an exterior wall and between a roof and ceiling of a building structure to provide a ventilation passageway to an air space between the ceiling and the roof and to prevent insulation which is subsequently applied to the ceiling from clogging said passageway, in which the exterior wall has a bearing plate on which ceiling joists and inclined parallel roof rafters are supported, said rafters being spaced from each other a first predetermined distance and said roof and bearing plate being spaced from each other a second predetermined distance, said combination insulation stop and ventilation baffle comprising:

a body of stiff sheet material having (a) a length dimension between end edges greater than the second predetermined distance, and (b) a width dimension between side edges greater than the first predetermined distance;

said body having parallel side fold lines formed therein adjacent to and spaced from the side edges defining side sections between the side fold lines and the side edges and a central section between the parallel side fold lines in which the distance across the central section between the side fold lines is slightly less than the first predetermined distance to enable the side sections to be pivoted relative to the central section and the body inserted between two rafters over the exterior wall, with the side sections bearing against the rafters and one end edge operatively engaging the bearing plate, the remaining end edge projecting into the air space to define a ventilation passageway;

an elongated rod of a length dimension greater than said first predetermined distance extending across the width of said body and having opposite ends projecting through said side sections;

clamp members receivable on the rod ends and selectively positionable thereon for engaging the side section to hold them in a selected angular relationship to the central body section.

2. The combination as set out by claim 1 wherein said body includes an end fold line formed therein extending perpendicularly between the side fold lines forming a flexible end tab which may be freely pivoted about the end fold line between the rafters relative to the central section.

3. The combination as set forth in claim 1 wherein the side sections include spaced slots extending inwardly from the side edges to the fold lines to define fold tabs between the spaced slots, said tabs receiving the opposite ends of the elongated rod.

4. The combination as set forth in claim 1 wherein the elongated rod is formed of a resilient material and the clamp members are spring clips that slide freely in only one direction over the rod and grip the rod in resistance to sliding motion in an opposite direction thereon.

* * * * *